US005809820A

United States Patent [19]

Morimoto

[11] Patent Number: 5,809,820

[45] Date of Patent: Sep. 22, 1998

[54] SPRING WASHER AND METHOD FOR MAKING THE SAME

[75] Inventor: Toshiaki Morimoto, Sakai, Japan

[73] Assignee: Nissan Screw Co., Ltd., Japan

[21] Appl. No.: 863,281

[22] Filed: May 27, 1997

[51] Int. Cl.[6] ..... B21B 13/10

[52] U.S. Cl. ..... 72/225; 72/366.2; 72/703; 470/41; 470/42

[58] Field of Search ..... 72/135, 136, 197, 72/198, 221, 224, 225, 226, 235, 252.5, 366.2, 703; 470/41, 42, 162, 163

[56] References Cited

U.S. PATENT DOCUMENTS

| | | | |
|---|---|---|---|
| 1,999,082 | 4/1935 | Buechting | 470/42 |
| 3,497,890 | 3/1970 | Coyle | 72/197 |
| 4,285,084 | 8/1981 | Brady et al. | 470/163 |
| 4,302,136 | 11/1981 | Abe et al. | 470/42 |

FOREIGN PATENT DOCUMENTS

| | | | |
|---|---|---|---|
| 136931 | 8/1979 | Germany | 72/136 |
| 2-199316 | 7/1990 | Japan . | |
| 6-297063 | 10/1994 | Japan | 470/41 |

*Primary Examiner*—Joseph J. Hail, III
*Assistant Examiner*—Ed Tolan
*Attorney, Agent, or Firm*—Morrison Law Firm

[57] ABSTRACT

A spring washer improves resistance to loosening of fasteners tightened thereon. The spring washer is stronger than prior art devices. On the upper and lower surfaces of the spring washer, approximately ⅕–¼ of the width inward from the outer perimeter is formed without V-shaped grooves. The remaining flat portions are formed with V-shaped grooves in various patterns. These V-shaped grooves increase the coefficient of friction and resist loosening of the spring washer.

3 Claims, 7 Drawing Sheets

FIG. 1
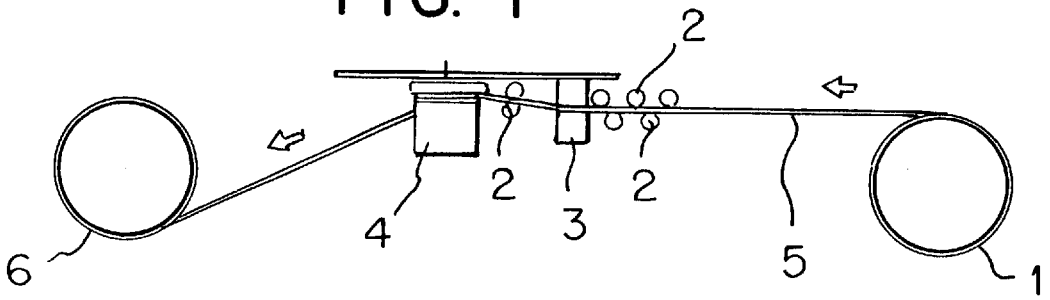
FIG. 2
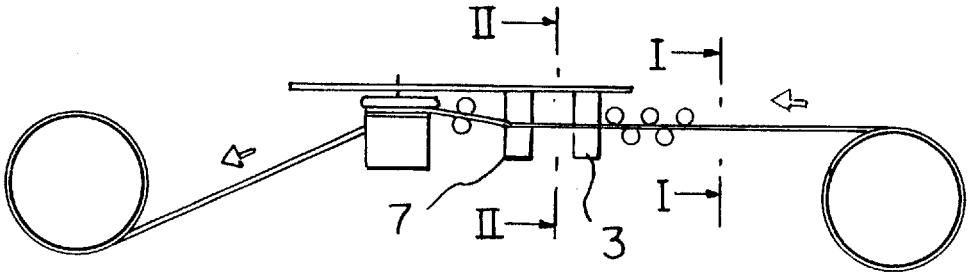
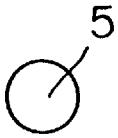
FIG. 3(a)
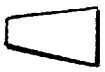
FIG. 3(b)
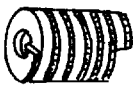
FIG. 3(c)
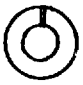
FIG. 3(d)

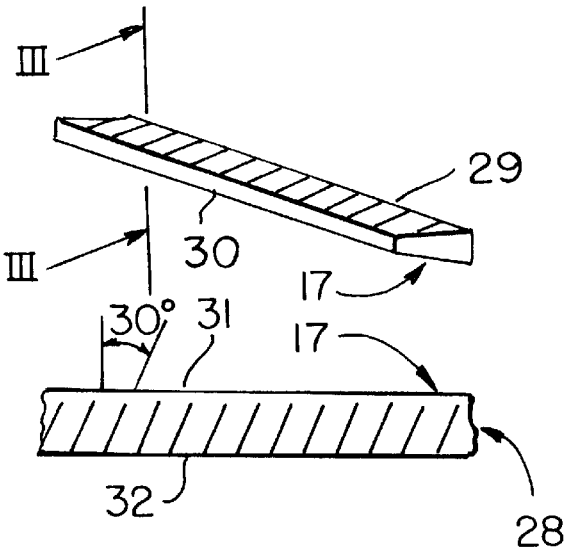
FIG. 9(a)
FIG. 9(b)
FIG. 11
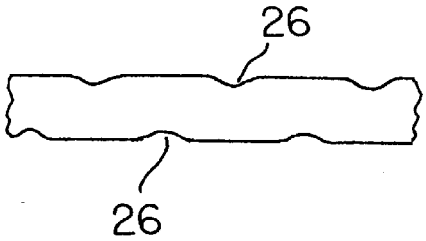
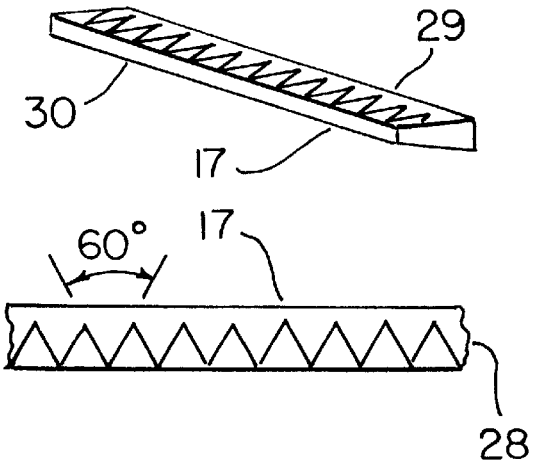
FIG. 12(a)
FIG. 12(b)

SPRING WASHER AND METHOD FOR MAKING THE SAME

BACKGROUND OF THE INVENTION

The present invention relates to an improvement in and method for making spring washers (JIS B1251), which are used to resist looseness in bolts and which are used quite widely in industry.

Despite the fact that spring washers have been in general use, the shape of the spring washers have changed very little.

Japanese Examined Patent Publication No. 56-3891 discloses an improvement in the method for making spring washers. Referring to FIG. 6, there has also been disclosed Japanese Utility Model Laid-open Publication No. 56-15819. As in the present invention, the object of this disclosure was to improve the shape of the spring washer.

The technology involving the forming of a ridges on the surface of bolts to improve tightness has been known. The formation of ridges on the spring washer has been disclosed in Japanese Utility Model Laid-open Publication No. 56-15819.

However, in this invention, ridges are formed on the upper and lower surfaces. This creates a fatal design flaw. When such a washer is actually used in attaching a bolt, the offset at opening 40 of the spring washer is closed, and the spring washer is pressed flat against the bolt and the surface to be bolted.

In this case, a large tension acts on the outer portion of the spring washer. The ridged portion that reaches to the outer perimeter acts as a cut-out, which serves to greatly concentrate the stress, resulting in fractures that make practical usage impossible.

When the twisting test specified in JIS (Japan Industrial Standard) B1251 is performed, the washer breaks.

OBJECTS AND SUMMARY OF THE INVENTION

The object of the present invention is to provide a spring washer on which a plurality of V-shaped grooves is disposed to facilitate tightening so that the washer resists looseness and also does not break. A further object of the present invention is to provide a spring washer that is strong enough to pass the twisting test specified by JIS. A further object of the present invention is to provide a method for pressing V-shaped tightening grooves automatically and consecutively using a simple device.

Briefly, a spring washer of the present invention improves resistance to loosening of fasteners tightened thereon. The spring washer is stronger than prior art devices. On the upper and lower surfaces of the spring washer, approximately ⅕–¼ of the width inward from the outer perimeter is formed without V-shaped grooves. The remaining flat portions are formed with V-shaped grooves in various patterns. These V-shaped grooves increase the coefficient of friction and resist loosening of the spring washer.

According to an embodiment of the present invention, there is disclosed, a spring washer comprising: said spring washer having an upper surface and a lower surface, said upper surface and said lower surface including flat surfaces, a plurality of grooves on a first portion of at least one of said upper surface and said lower surface, whereby loosening of a fastener tightened on said spring washer is resisted, and said at least one of said upper surface and said bottom surface having a second portion, abutting an outermost perimeter of said spring washer, without said grooves.

According to another embodiment of the present invention, there is disclosed, a spring washer, comprising: said spring washer having an upper surface and a lower surface, said upper surface and said lower surface including flat surfaces, a plurality of grooves on a portion of said upper surface and said lower surface, whereby loosening of a fastener tightened on said spring washer is resisted, and said upper surface and said bottom surface have a second portion, abutting an outermost perimeter, without grooves.

According to another embodiment of the present invention, there is disclosed, a spring washer comprising: an upper surface and a lower surface, said upper surface and said lower surface including flat surfaces, a plurality of grooves arranged in a "fish scale" arrangement on a first portion of at least one of said upper surface and said lower surface, whereby loosening of a fastener tightened on said spring washer is resisted, and said at least one of said upper surface and said bottom surface has a second portion, abutting an outermost perimeter, without said grooves.

According to yet another embodiment of the present invention, there is disclosed, a method for impressing grooves into surfaces of spring washers comprising the steps of: inserting a rolled material between at least two guide rollers and at least one pressing roller, said at least one pressing roller having knurling surfaces, inclining said at least one pressing roller to match an incline of said rolled material, adjusting a pressure applied to said rolled material by said at least one pressing roller to adjust a depth of said grooves which are pressed into said rolled material by said knurling surfaces of said at least one pressing roller, adjusting a position of said rolled material relative to said at least one pressing roller such that said grooves are not formed on a first portion of said rolling material, which abuts an outermost perimeter of said spring washer, feeding said rolled material through said at least two guide rollers and said at least one pressing roller such that said knurls of said at least one pressing roller impress grooves on said rolled material, and coiling said rolled material.

In the present invention, a plurality of V-shaped tightening grooves 26 is formed on the upper and lower surfaces 21, but grooves are not formed on a prescribed portion toward an outer perimeter 27 of a spring washer 18.

In the JIS B1251 specifications, bevels or curves are disposed at a corner 22 of the inner perimeter of spring washer 18 so that interference with the curve at the bottom of the bolt head can be avoided. The dimensions of the bevels or curves are included in the specifications. In the present invention, a portion toward the outer perimeter on the upper and lower surfaces is formed without grooves. This portion has a dimension, slightly larger than that of the bevels or curves described above, of approximately ⅕–¼ of the width of surface 21. This prevents the V-shaped groove on the upper and lower surfaces from reaching to the bevels or curves toward an outer perimeter 19. The absence of V-shaped grooves on a portion of the spring washer prevents the V-shaped grooves from acting as cut-out cavities. Thus, when the washer is compressed and tension is applied to the outer perimeter of the upper and lower surface, the stress does not get concentrated. This prevents the washer from being broken.

The V-shaped grooves do not need to go very deep as long as the coefficient of friction at upper and lower surfaces 21 is large enough and as long as the JIS twisting test can be performed.

Inner perimeter 20 of surface 21 of spring washer 18 receives compressive force when the spring washer is compressed during usage. The spring washer is not in danger of breaking even if the V-shaped grooves reach to the inner perimeter, but it would still be desirable to have grooves absent from a portion at inner perimeter 20 of the surfaces that is approximately ⅕–¼ of the width of the surface.

It would also be possible to have V-shaped grooves absent from ⅕–¼ of upper and lower surfaces 21 toward outer perimeter 19 of spring washer 18, and to have a spiral V-shaped groove disposed on the remaining surface in a direction that resists loosening of the bolt (FIG. 8). This would increase the friction coefficient of the surface. A "fish scale" pattern (FIG. 10) on the surface could also be used to increase the friction coefficient.

A fish scale pattern can be used since the method for production would be similar to that of spiral-shaped grooves, and the results would be equally effective.

Furthermore, instead of the spiral grooves and the fish scale patterns described above, it would also be possible to press fine V-shaped grooves using a similar method for production. This can easily increase the coefficient of friction, and provide for high friction coefficients on the upper and lower surfaces of the spring washer (FIG. 13).

It would be possible to have V-shaped grooves absent only toward outer perimeter 19 of upper and lower surfaces 21 of the spring washer. It would also be possible to have V-shaped grooves absent both toward the outer perimeter and the inner perimeter.

When the bolt is assembled and tightened with the spring washer, the V-shaped grooves pressed on upper and lower surfaces 21 of the spring washer causes plastic deformation to take place in the member that comes into contact with the V-shaped grooves. This plastic deformation results in a slight expansion into the V-shaped grooves, thus increasing the coefficient of friction. This fact can be clearly seen by the imprint left on the member that comes into contact with the V-shaped grooves. This is especially effective when the material to be tightened against is a soft material such as cast material or aluminum.

Generally, profile rolling mills are used to make spring washers. In addition to a profile rolling unit 3, the present invention uses a pressing unit 7 for pressing V-shaped grooves on the spring washer. In the present invention, a continuously drawn round wire material 5 is rolled. Then, V-shaped grooves are pressed on rolled material 17 using a pressing unit, in which a pressing roller 11 containing a knurling surface is attached.

A maximum of four pressing rollers 11 and a maximum of four guide rollers 15 are attached to the pressing unit. The rolled material 17 is passed between these so that the material is guided and pressed. Adjustment screws 9, 10 are provided for each roller.

Adjustment screw 9 for the pressing roller applies pressure to rolled material 17 so that the depth of the V-shaped grooves to be pressed can be adjusted.

Rolled material 17 is tapered on both sides. In order to take these angles into consideration, pressing roller 11 is attached to a frame 8 at an incline via a pressing roller holder 12.

The various V-shaped lines pressed on upper and lower surfaces 21 of the rolled material can be freely changed and selected based on the angles and the number of grooves on the knurling surfaces attached to the pressing roller.

Once the straight V-shaped grooves are pressed onto the rolled material, the material is coiled. Various patterns can be formed with V-shaped grooves on upper and lower surfaces 21 of the spring washer. This results in the tightening spring washer of the present invention.

A spring washer having V-shaped grooves pressed on upper and lower surfaces 21 is assembled with a bolt and the bolt is tightened. The axial tension of the bolt results in plastic deformation in the bolt surface and the attachment surface against which the V-shaped grooves come into contact. The plastic deformation results in a slight expansion of material into the V-shaped grooves and increases the coefficient of friction. This is evident from the clear imprint left on the attachment member where it comes into contact with the V-shaped grooves.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 is a drawing of a standard profile rolling device.

FIG. 2 is a schematic drawing showing a pressing unit disposed in a profile rolling device.

FIGS. 3(*a*)–(*d*) are drawings showing some of the production steps involved in standard spring washers.

FIG. 3(*a*) shows the continuous drawing step.

FIG. 3(*b*) shows the profile rolling step.

FIG. 3(*c*) shows the coiling step.

FIG. 3(*d*) shows the cutting step.

FIG. 6(*a*) is a front-view drawing.

FIG. 6(*b*) is a side-view drawing.

FIG. 6(*c*) is an enlarged drawing of the cross section along line AA.

FIG. 7(*a*) shows the original state.

FIG. 7(*b*) shows the state where the spring washer is twisted 90 degrees.

FIG. 8(*a*) is a perspective drawing.

FIG. 8(*b*) is a side-view drawing.

FIG. 8(*c*) is a drawing as viewed from arrow A (bottom view).

FIGS. 9(*a*) and 9(*b*) are schematic drawings showing V-shaped grooves pressed on a rolled material.

FIG. 10(*a*) is a perspective drawing.

FIG. 10(*b*) is a side-view drawing.

FIG. 10(*c*) is a bottom-view drawing.

FIG. 11 is a cross-section drawing of the rolled material showing the V-shaped grooves.

FIGS. 12(*a*) and 12(*b*) are schematic drawings showing V-shaped grooves pressed on a spring washer to form a fish scale pattern.

FIG. 13(*b*) is a schematic drawing showing a spring washer where the V-shaped grooves in FIG. 10(*a*) are made finer so that the coefficient of friction is increased. The drawing shows an example where V-shaped grooves are not formed toward the inner perimeter.

DETAILED DESCRIPTION OF THE PREFERRED EMBODIMENTS

As disclosed in Table 1 in Japanese Examined Patent Publication No. 56-3891, the method for making spring washers that is being used currently involves the following steps: (1) patenting, (2) continuous drawing, (3) profile rolling, (4) coiling, (5) cutting, and (6) blueing (heating at a low temperature between about 250° and 350° degrees C.

Referring to FIG. 1, there is shown a standard profile rolling device. Referring to FIG. 2, there is shown a pressing unit 7 placed in the standard profile rolling device. Pressing unit 7 presses V-shaped grooves onto the tightening spring washer of the present invention.

Figure 4:
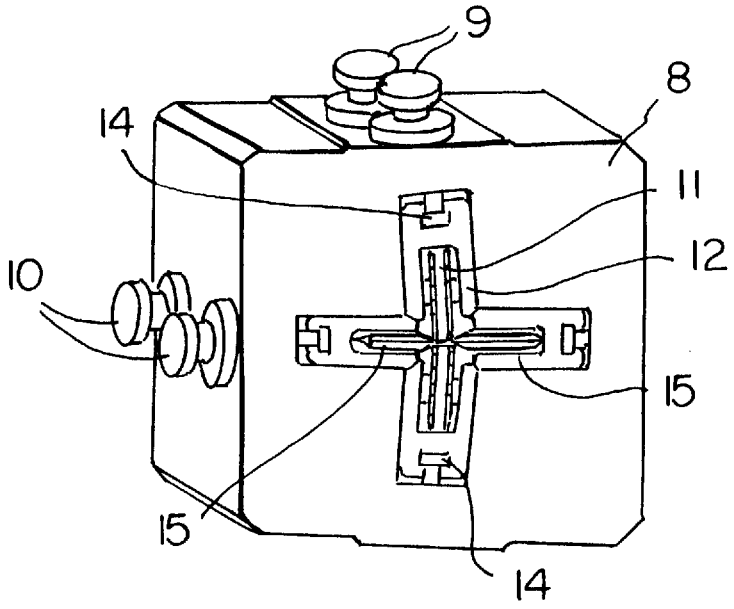
FIG. 4 is a schematic drawing of a pressing unit.
Figure 5:
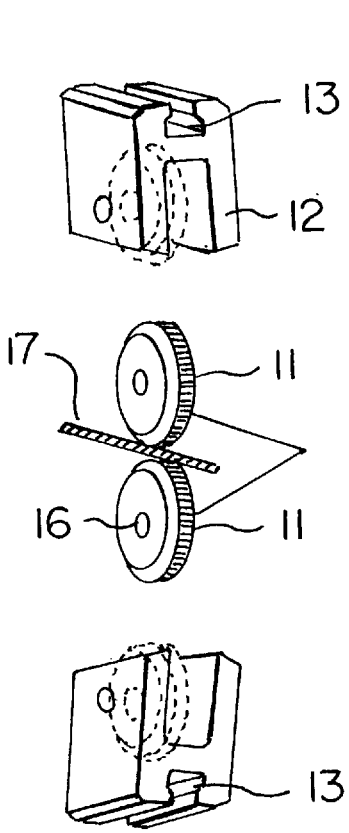
FIG. 5 is an exploded perspective drawing of a pressing roller.
Figure 6A:
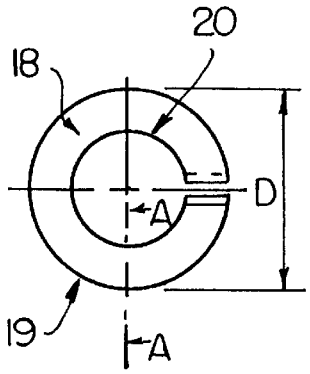
FIGS. 6(*a*)–(*c*) are schematic drawings of a spring washer as specified in JIS B1251.
Figure 6B:
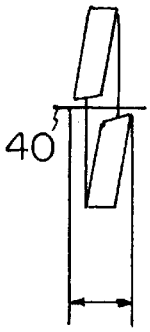
Figure 6C:
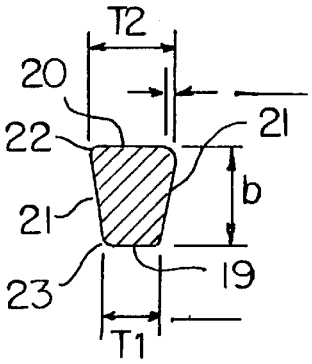
Figure 7A:
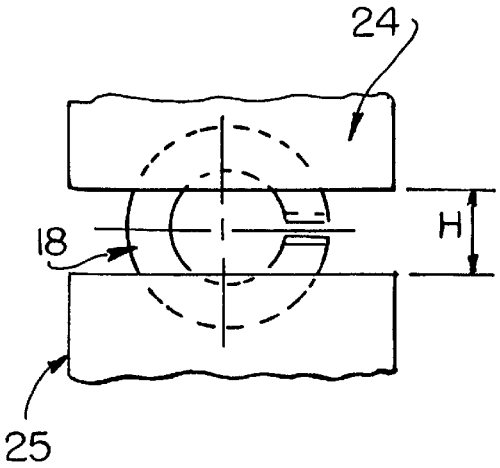
FIGS. 7(*a*)–(*b*) are drawings showing the twisting test specified in JIS B1251. The test involves twisting the washer so that the free height increases. The washer must not break at twisting angles of less than 90 degrees.
Figure 7B:
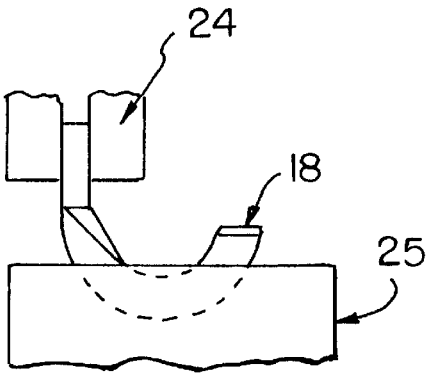

Referring also to FIG. 4, a maximum of four guide rollers 15 and a maximum of four pressing rollers with knurling surfaces 11 are attached to pressing unit 7 (two of each roller type is hidden in FIG. 4). The pressing rollers with knurling surfaces are rotatably supported in four pressing roller holders 12 with T-shaped grooves via shafts (not shown in the drawing), and shaft holes 16. The pressing rollers are supported in a frame 8 via pressure adjustment screws 9 (the lower two screws are not shown in the drawing), which have T-shaped projections. Pressure adjustment screws 9 allow the pressing rollers to move vertically. A maximum of four internal threads for tightening the pressure adjustment screws are disposed on the frame.

Four pressure adjustment screws 9 are disposed to correspond to the four pressing rollers 11. The four guide rollers 15 are rotatably supported by guide roller holders in a manner completely identical to the pressing rollers. T-shaped grooves are disposed on the guide roller holders, and adjustment screws having T-shaped projections (neither of these are shown in the drawings) provide support so that the guide rollers can move horizontally. There are four adjustment screws, but the two screws on the right are not shown in the drawing. Four internal threads (not shown in the drawing) are disposed on the frame to allow tightening the adjustment screws, in a manner completely identical to that of the pressing rollers.

To give one example, a spring washer having a size of 3–12 mm may be made from a rolled material 17 having four-degree tapers on either end. Thus, in this example, the pressing roller holders, the pressing rollers, and the pressure adjustment screws would all be sloped at four degrees.

When the material is to be coiled, i.e. when the final product shape is to be formed, a thick portion 29 of rolled material 17 would be a thin portion 19 of the product, and a thin portion 30 of the rolled material would be a thick portion 20 of the product. Therefore, tapers are formed on both sides of rolled material 17.

The guide rollers can provide guiding pressure from a horizontal orientation and do not need to be inclined at four degrees as with the pressing rollers.

Referring again to FIG. 4, the following is a description of how V-shaped grooves are pressed onto rolled material 17 using the two front pressing rollers 11 and two guide rollers 15 in the pressing unit. The other two sets of rollers are eliminated in this example.

Figure 8A:
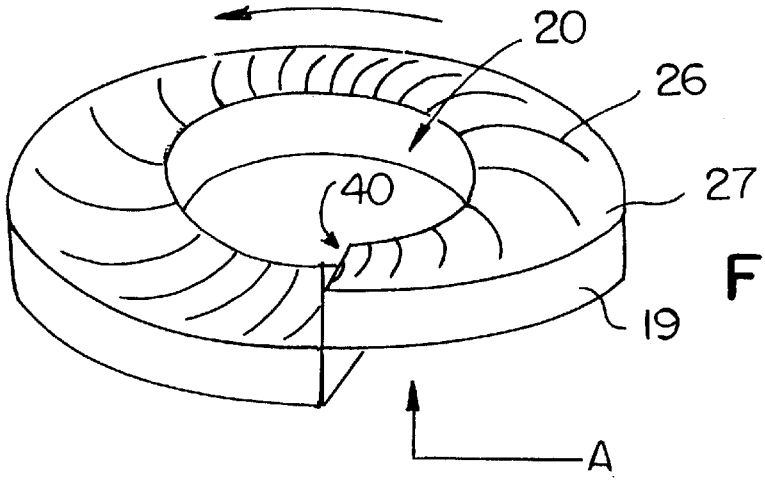
FIGS. 8(*a*)–(*c*) are drawings showing a spring washer where V-shaped grooves are pressed in a direction that resists loosening at the contact surfaces with the bolt and the opposing member.
Figure 8B:
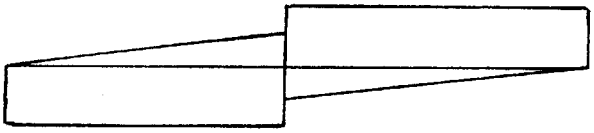
Figure 8C:
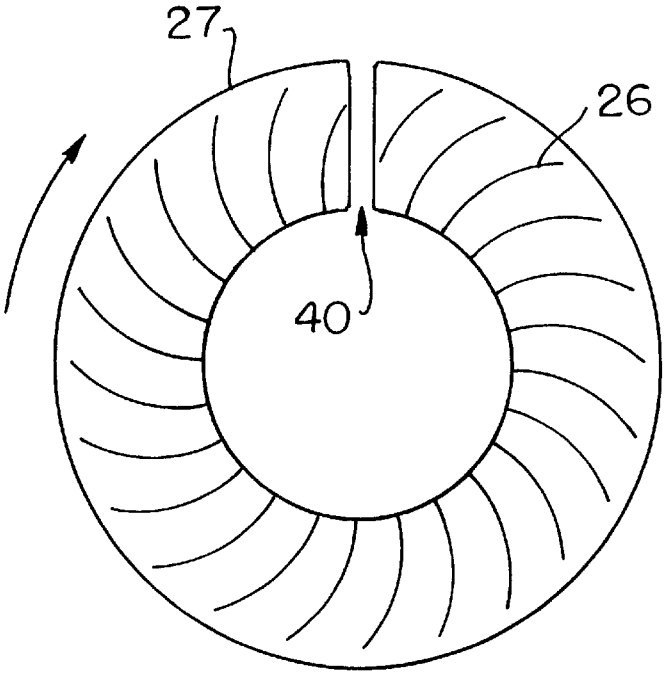
Figure 10A:
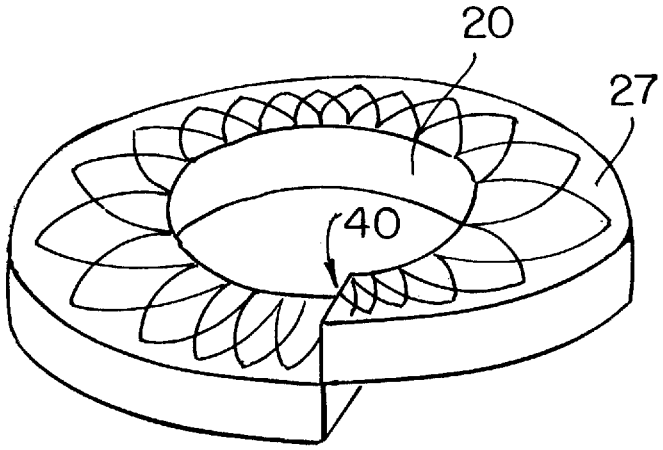
FIGS. 10(*a*)–(*c*) are drawings showing a spring washer on which V-shaped grooves are pressed in a fish scale pattern.
Figure 10B:
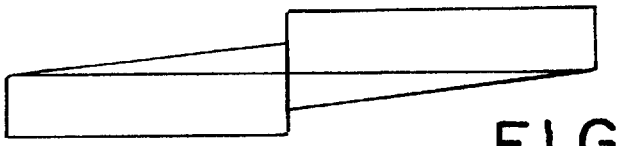
Figure 10C:
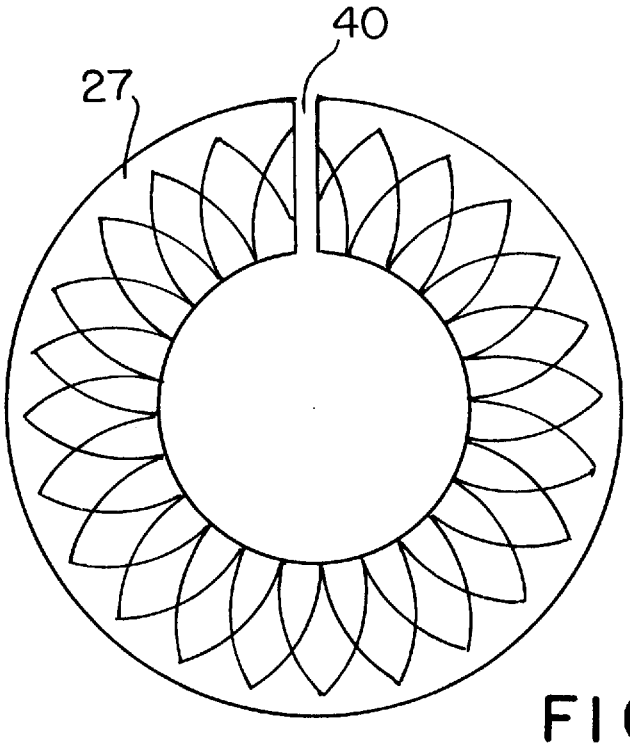

Referring to FIGS. 9(*a*) and 9(*b*), V-shaped grooves are pressed at a 30 degree angle along the axis of motion of rolled material 17. The back side is the reverse of this. Rolled material 17 is linear with tapers on both sides. When this material is coiled in the next step, thick portion 29 of the rolled material becomes thin portion 19, i.e. the outer portion, and the thin portion 30 of the rolled material becomes thick portion 20, i.e. the inner portion. Thus, a large degree of tension is applied toward outer perimeter 31, focused on the center of a width 28 of the pressed material, causing the material to expand, while a compressive force acts toward inner perimeter 32. Thus, when the material is coiled, the outer diameter and the inner diameter will have different perimeter lengths in the final product. This results in a gentle, spiral shape (See FIGS. 8(*a*)–8(*c*)) for the V-shaped groove pressed in rolled material 17. When the washer is bolted in a clockwise manner, the spiral V-shaped grooves will prevent the bolt from loosening. See FIG. 8(*a*), (*c*).

In the spring washer of the present invention, V-shaped grooves can be kept absent from a prescribed portion on the outer perimeter by using adjustment screws 10 to adjust the position of guide rollers 15 in the pressing unit. This will prevent V-shaped grooves from being pressed onto thick portion 29 of rolled material 17.

V-shaped grooves can be kept absent from prescribed portions on the outer and inner perimeters by using a knurling surface and rolling the pressing roller along the center of rolled material 17. The width of the knurling surface should be such that grooves are not pressed onto thick portion 29 and thin portion 30 of the rolled material.

The following is a description of using the four pressing rollers and the four guide rollers in the pressing unit to form V-shaped grooves.

Referring again to FIG. 4, there is shown a pressing unit where the two upper pressing rollers are inclined alternately at thirty degrees relative to the direction of motion of rolled material 17 (FIGS. 12(*a*) and 12(*b*)). As the rolled material is moved forward, a plurality of V-shaped grooves is pressed on the upper surface of rolled material 17, as shown in FIGS. 12(*a*) and 12(*b*). The two lower pressing rollers similarly press a plurality of V-shaped grooves on the lower surface of rolled material 17. The angle of thirty degrees used here is given just as an example.

The material is then coiled in the same manner as the spring washer with the spiral V-shaped grooves described above. This results in a spring washer on which are pressed V-shaped grooves having a fish scale pattern, resulting in a large coefficient of friction.

Figure 13A:
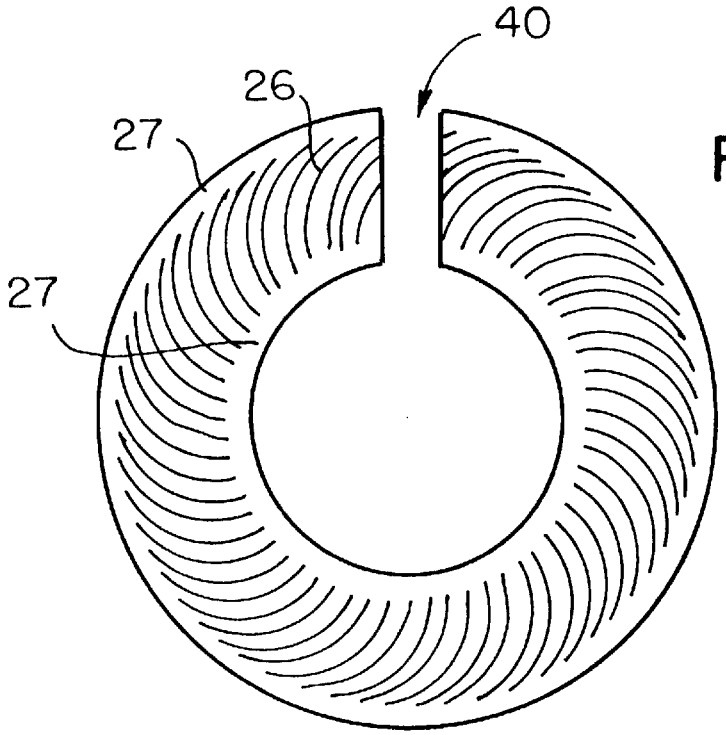
FIG. 13(*a*) is a schematic drawing showing a spring washer where the V-shaped grooves in FIG. 8(*a*) are made finer so that the coefficient of friction is increased. The drawing shows an example where V-shaped grooves are not formed toward the inner perimeter.
Figure 13B:
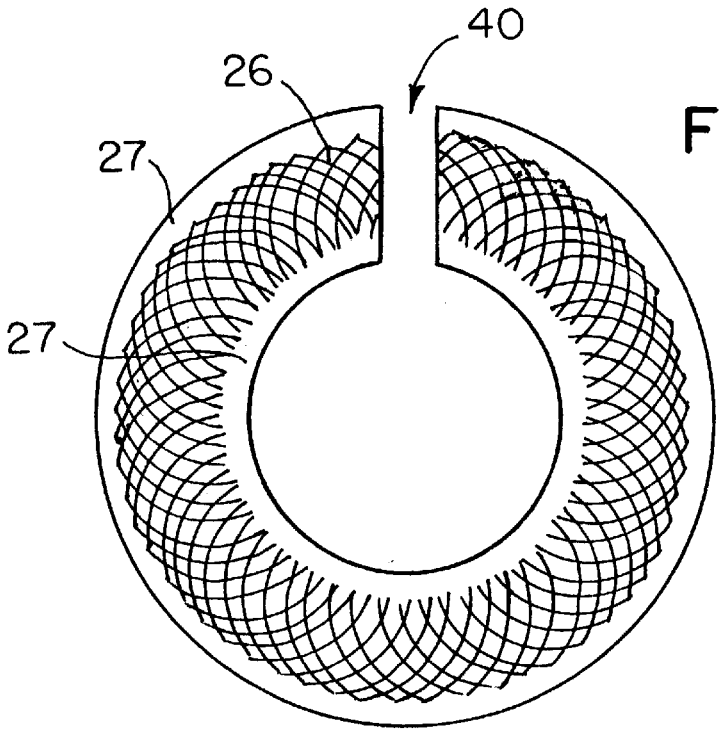

The pressing of spiral V-shaped grooves oriented to resist loosening can be performed as described previously. This method can be used with finer knurling surfaces so that it is possible to press fine spiral V-shaped grooves 26 as shown in FIG. 13(*a*). Fine knurling surfaces can be used with the pressing of V-shaped grooves in a fish scale pattern as described above. The result is as shown in FIG. 13(*b*), where an extremely large number of V-shaped grooves 26 are formed on the upper and lower surfaces of the spring washer, thus increasing the coefficient of friction and improving resistance to loosening. By changing the shape of the knurling surfaces on the pressing roller, it is possible to make V-shaped grooves in any arrangement on the upper and lower surfaces of the spring washer.

It is possible to use two guide rollers and one pressing roller, with one support roller taking the place of the other pressing roller. This makes it possible to press spiral V-shaped grooves that resist loosening on one side of the spring washer only. Referring to FIG. 4, by using four guide rollers and two pressing rollers on the top and two support rollers on the bottom, it is possible to press a plurality of V-shaped grooves in a fish scale pattern on one side of the spring washer only. In these cases, support rollers comprise discs with no knurling surfaces.

As described above, the present invention has the following advantages.

When V-shaped grooves are pressed on both upper and lower surfaces 21 of a spring washer, the tightening of the bolt will result in plastic deformation in the bolt surface and the opposing member due to the axial tension of the bolt. The material will slightly expand into the V-shaped grooves, thus increasing the coefficient of friction and preventing loosening of the bolt.

Spring washers with V-shaped grooves on the upper and lower surfaces are very effective on bolts that have not been heat treated through quenching, tempering, or the like. Of course, the spring washers will also be effective on heat treated washers as well, but they will be especially effective when the opposing member is a relative soft material such as cast material or aluminum. Also, spring washers having V-shaped grooves only on one side can be effective since spring washers themselves have their own properties that prevent loosening, i.e. the spring action of the washer and the embedding of the cut end at the offset gap of the washer.

Thick portion 29 of the material during profile rolling becomes the thin outer portion 19 in the coiled final product. V-shaped grooves are not formed on approximately ⅕–¼ of the outer portion, so that even if very high tension is applied during coiling, the absence of cut-out portions prevents concentration of stress during coiling, thus preventing fractures.

Since a prescribed outer portion 27 is formed without V-shaped grooves, the spring washers can be tested with the JIS twisting test. When the spring washers are used in their final form, the offset gap is closed due to compressive force, and tension acts on the outer perimeter portion. However, since no V-shaped grooves are formed on this portion, fractures due to concentrated stress from cut-outs are avoided.

When the spring washer is compressed, compressive force is applied to inner perimeter 20 of surface 21 of the spring washer. Thus, even if V-shaped grooves are formed up to inner perimeter 20, there is no danger of breaking. However, it would be desirable to also have a portion toward the inner perimeter that does not have V-shaped grooves.

No modifications are needed on the standard profile rolling device. The pressing unit is placed between the profile rolling unit and the drum. This allows easy pressing of various arrangements of linear V-shaped grooves on one or both sides of the rolled material. By coiling this material, various arrangements of V-shaped grooves can be formed on the upper and lower sides of the spring washer.

In pressing unit 7 of the present invention, guide rollers 15 with adjustment screws 10 and pressing rollers 11 with pressure adjustment screws 9 are disposed. Pressing rollers 11 with knurling surfaces are sloped according to the incline of rolled material 17. The incline of the linear knurling surface well as the number of ridges on the tool can be modified. Thus, spring washers can be formed with various arrangements of V-shaped grooves formed on one side or both sides of the spring washer.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method for impressing grooves into surfaces of spring washers comprising the steps of:

inserting a rolled material between at least two guide rollers and at least one pressing roller, said at least one pressing roller having knurling surfaces;

inclining said at least one pressing roller to match an incline of said rolled material;

adjusting a pressure applied to said rolled material by said at least one pressing roller to adjust a depth of said grooves which are pressed into said rolled material by said knurling surfaces of said at least one pressing roller;

adjusting a position of said rolled material relative to said at least one pressing roller such that said grooves are not formed on a first portion of said rolling material, which abuts an outermost perimeter of said spring washer;

feeding said rolled material through said at least two guide rollers and said at least one pressing roller such that said knurls of said at least one pressing roller impress grooves on said rolled material; and coiling said rolled material.

2. The method for impressing grooves into surfaces of spring washers of claim 1, wherein the step of adjusting a pressure includes turning pressure application screws which adjust a position of said at least one pressing roller.

3. The method for impressing grooves into surfaces of spring washers of claim 1, wherein said step of adjusting a position of said rolled material includes further adjusting a position of said pressing rollers such that said grooves are not formed on a second portion of said rolling material, which abuts and innermost perimeter of said spring washer.

* * * * *